United States Patent [19]

McNeil

[11] 3,972,529

[45] Aug. 3, 1976

[54] REINFORCED TUBULAR MATERIALS AND PROCESS

[76] Inventor: Walter F. McNeil, 221 Ridge Road, Stratford, Conn. 06497

[22] Filed: Oct. 7, 1974

[21] Appl. No.: 512,917

[52] U.S. Cl. ..... 273/80 B; 156/257; 29/155 C; 428/36; 428/367; 280/11.37 L; 273/73 H

[51] Int. Cl.[2] ..... A63B 53/12

[58] Field of Search ..... 273/67 R, 72 R, 72 A, 273/73 R, 73 C, 73 F, 73 H, 73 K, 80 R, 80 B, 80.9; 116/173; 280/11.37 B, 11.37 D, 11.37 L; 135/15 PQ; 52/40; 114/90; 29/155 R, 155 C; 272/59 C; 428/36, 367, 398, 379

[56] References Cited

UNITED STATES PATENTS

| | | | |
|---|---|---|---|
| 1,535,667 | 4/1925 | Horne | 273/80 R X |
| 1,688,473 | 10/1928 | Sippel | 273/80 B |
| 1,963,057 | 6/1934 | Wilcox | 273/80.9 X |
| 2,099,126 | 11/1937 | Larsen | 273/80 R X |
| 2,887,762 | 5/1959 | Dosell | 273/73 H X |
| 2,923,652 | 2/1960 | Oka | 273/DIG. 7 |
| 2,944,820 | 7/1960 | Paullus | 273/72 R |
| 3,349,157 | 10/1967 | Parsons | 273/73 F |
| 3,462,289 | 8/1969 | Rohl et al. | 273/DIG. 23 |
| 3,487,518 | 1/1970 | Hopfeld | 273/DIG. 7 |
| 3,491,055 | 1/1970 | Talley | 273/DIG. 23 |
| 3,614,101 | 10/1971 | Hunter | 273/80 B X |
| 3,727,936 | 4/1973 | Klir et al. | 280/11.13 L |
| 3,787,051 | 1/1974 | Johns | 273/DIG. 7 |
| 3,813,098 | 5/1974 | Fischer et al. | 273/DIG. 7 |

FOREIGN PATENTS OR APPLICATIONS

| | | | |
|---|---|---|---|
| 66,555 | 7/1943 | Norway | 280/11.37 L |
| 223,323 | 2/1943 | Switzerland | 280/11.37 L |
| 1,312,731 | 4/1973 | United Kingdom | 273/DIG. 7 |

OTHER PUBLICATIONS

"Engineering Materials and Design;" Mar. 1969; p. 7.

*Primary Examiner*—Richard J. Apley

[57] ABSTRACT

This invention concerns hollow, tubular, lightweight metallic elements, particularly those of tubular aluminum, magnesium, titanium or other lightweight metals, having increased strength, stiffness and other properties. The invention involves the lengthwise application of unidirectional graphite fiber strips within recesses cut along the outer surface of metallic elements at least in key stress areas to provide the advantages enumerated above, the weight of the fiber strips being less than the weight of the metal removed to form said recesses.

8 Claims, 5 Drawing Figures

REINFORCED TUBULAR MATERIALS AND PROCESS

The present invention is concerned primarily with the production of improved golf club shafts, particularly those formed of aluminum. Aluminum golf club shafts have been produced in large numbers and have met with some degree of commercial success because of their low cost, light weight and excellent torque characteristics. However, aluminum also has relatively low strength, low stiffness and poor recovery, which disadvantages have led to a rapid decline in the use of aluminum golf club shafts. The foregoing also applies to other light-weight metals such as magnesium, titanium, and the like, and to the use of all of these metals, including aluminum, in tubular form for use as ski poles, tennis rackets, bicycle frames, tent supports, structural elements, and the variety of other uses to which such tubular metals are conventionally applied.

In the golf club shaft art, it has been proposed to make such shafts from graphite fiber composition since this material is light in weight and has excellent stiffness. However, such shafts are extremely expensive and are difficult to produce compared to aluminum or other lightweight metals.

It is the principal object of the present invention to provide a method for increasing the strength, durability and stiffness characteristics of elongate metal bodies, particularly lightweight tubular metals, without substantially increasing the weight or the cost of such tubular materials.

It is another object of this invention to provide novel reinforced elongate bodies of lightweight metals which have dramatically increased stiffness characteristics in a stress/return application such as required of a golf club shaft, and have greater strength and durability than corresponding non-reinforced tubular elements of such metals.

It is another object of this invention, according to a preferred embodiment, to reinforce an elongate metal body while simultaneously reducing the weight thereof.

These and other objects and advantages of the present invention will be apparent to those skilled in the art in the light of the present disclosure including the drawings in which.

The present invention resides in the discovery that the strength, durability and stiffness characteristics of elongated metal bodies, particularly of lightweight tubular metals such as aluminum, magnesium, titanium and the like, can be increased dramatically by the lengthwise incorporation of continuous unidirectional graphite fiber strips which are integrated along the outer surface of the metallic bodies to become a part thereof. Such graphite fiber strips are extremely light in weight, rectangular in cross-section and are inlaid or recessed within the metallic body so as to have three sides firmly bonded to the metallic body while the fourth side is exposed along the surface of the metallic body and preferably is sanded flush therewith so as to impart a striped appearance to the metallic body. Thus the receptive recesses formed in the metallic body have a flat base and substantially parallel sides, as illustrated by the drawings.

The graphite fiber strips useful according to the present invention are rectangular strips of resin-bonded graphite fibers oriented in one direction corresponding to the length of the strips. Graphite has a hexagonal crystalline structure and the carbon atoms along a given plane are firmly bonded to each other, even more tightly than the carbon atoms in a diamond crystal. However, unlike the diamond, there is little bonding strength between different planes of graphite crystals. In unidirectional graphite strips, the graphite crystals are arranged in threadlike fibers which extend lengthwise along the strips whereby the strips have high strength and stiffness and excellent memory characteristics so that they can be flexed without breaking and they return to their original flatness without warping. Such unidirectional graphite fiber strips are well known and are commercially available. They are formed of graphite fibers and a resinous adhesive binder such as an epoxy resin, the fibers being aligned in a single direction corresponding to the length of the strips. A suitable composition consists of 60% by weight of the graphite fibers and 40% by weight of the resin binder, the strips preferably being formed from such compositions by protrusion methods. Such strips are lighter in weight than corresponding strips of lightweight metals such as aluminum, magnesium or titanium having identical dimensions.

Figure 1:
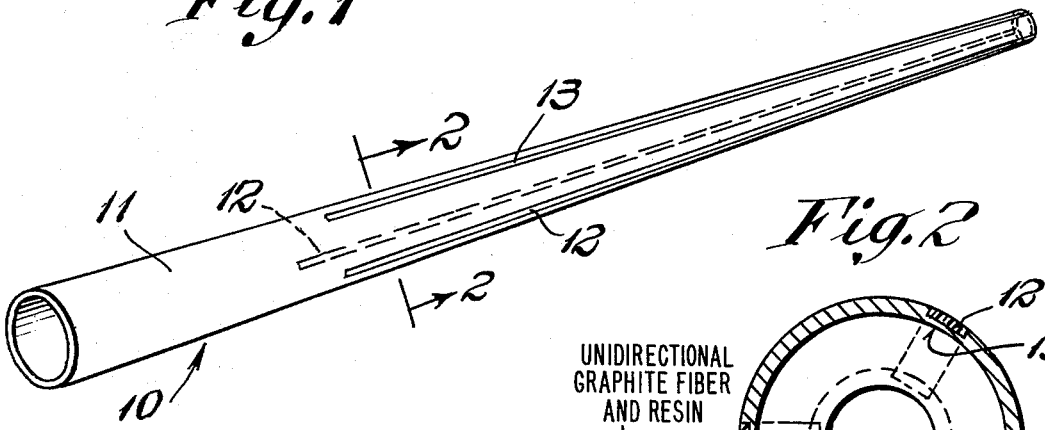
FIG. 1 is a perspective view of a segmented golf club shaft illustrating the graphite fiber strip inlay reinforcements according to the present invention.

While the dimensions of the graphite fiber strips and the spacing and number used according to the present invention will vary depending upon the thickness and surface area of the elongated metallic body to the reinforced, specific reference is made herein with respect to conventionally-sized aluminum golf club shafts. Such shafts, as illustrated in FIG. 1 of the drawings, are tapered tubular bodies having a maximum outer diameter of about 0.6 inch which tapers down to a minimum outer diameter of about 0.3 inch, the shaft being about 45 inches in length and the aluminum thickness ranging from about 0.035 inch at the butt end gradually increasing to about 0.045 inch at the narrow end. The rectangular graphite strips used in connection with such shafts preferably have a width of about ⅛ inch, a thickness of about 0.031 inch and a length of about 41 inches.

Figure 2:
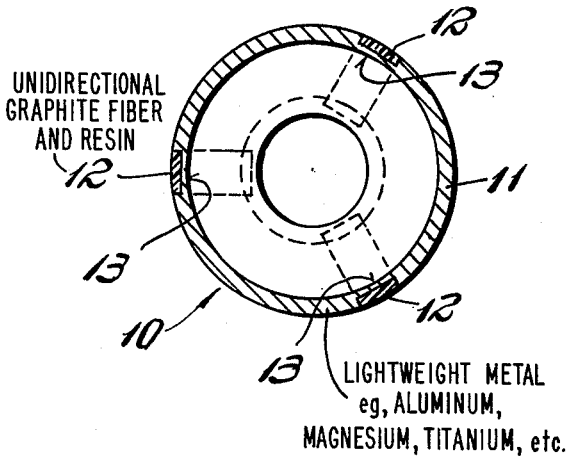
FIG. 2 is a cross-section of the golf club shaft of FIG. 1 taken along the line 2—2.

FIGS. 1 and 2 illustrate a preferred embodiment in which the golf club shaft 10 of tubular lightweight metal 11, such as aluminum, magnesium, titanium, or other lightweight metal has recessed therein three equally-spaced strips 12 of unidirectional graphite fiber and resin which are bonded within lengthwise notches or grooves 13 which are machine cut into the aluminum or are formed therein during the extrusion or drawing of the tubular aluminum so as to have a flat base and substantially parallel sides. The preformed graphite strips 12 are cut to size corresponding to the dimensions of the grooves 13 and are bonded within the grooves 13 by means of a suitable resinous adhesive cement, such as an epoxy resin cement which is applied to the grooves 13 or to the strips 12 or to both. The graphite strips 12 are then fitted within the grooves 13 and are pressed in place until the cement sets. Thereafter the outer surface of the shaft is machine sanded until the exposed surface of each graphite strip is rounded smooth to correspond with the roundness and smoothness of the tubular aluminum whereby the graphite strips are undetectable to the feel.

The number of graphite strips used in a golf club shaft may be varied between from two up to about six. It is preferred to use three strips, as shown in FIGS. 1 and 2, with one of the strips preferably being aligned with the faceplate of the club head so as to assist the golfer in positioning himself and the club relative to the golf ball to be hit.

The graphite fiber reinforcements dramatically increase the stiffness characteristics of the aluminum club shaft and its stress/return properties which are so important for golf club use. The "feel" of the club during use is substantially enhanced and the performance of the club with respect to distance and accuracy is improved and rendered more consistent than in the case of non-reinforced aluminum shaft clubs.

The method for forming the notched or grooved elongate metallic bodies used according to the present invention is not critical. As indicated supra, such bodies may be preformed such as by extrusion methods and thereafter notched or grooved by machine methods to remove metal from the surface and provide the notches, each notch or groove preferably extending at least half-way through the thickness of the metal. This reduces the weight of the metallic body which is important in the case of golf club shafts, ski poles, tennis rackets, and the like. It is also possible to form the metallic bodies with the desired notches or grooves therein such as by extruding the metallic bodies through orifices which provide such notches or grooves or by rolling or pressing the metallic bodies against a notched or grooved mandrel to form the required longitudinal recesses.

Figure 3:
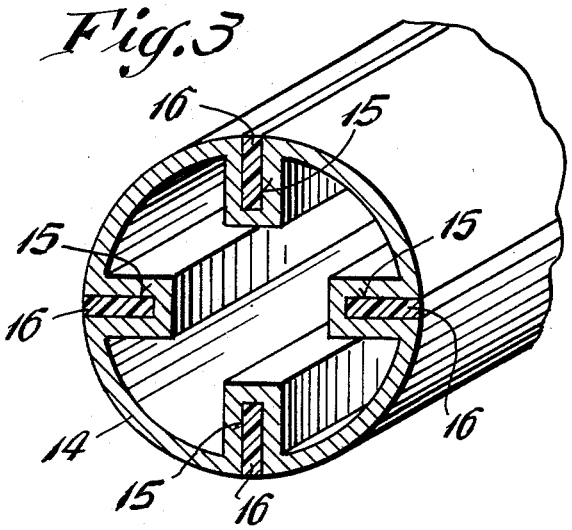
FIGS. 3, 4 and 5 are partial perspective cross-sectional views of metallic elements of different shapes containing graphite fiber strip inlay reinforcements according to different embodiments of the present invention.
Figure 4:
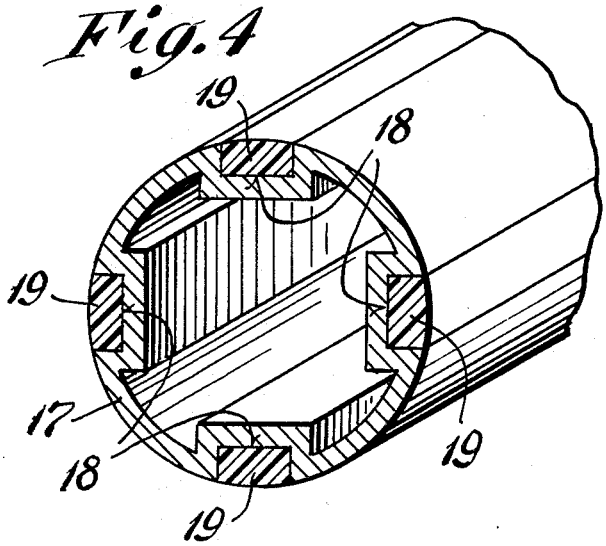
Figure 5:
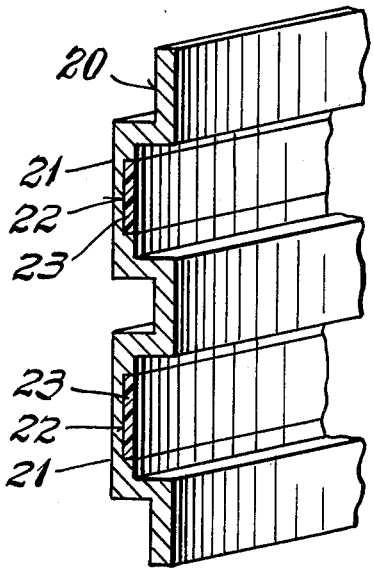

FIGS. 3 to 5 of the drawings illustrate other embodiments of the present invention employing elongate metallic bodies of different shapes. FIG. 3 illustrates a cylindrical tubular metallic body 14 which is extruded in a form having longitudinal deep and narrow radial slots 15 therein. Such slots are equally-spaced and are provided with unidirectional graphite fiber strips 16 which are bonded within the length of the slots by means of a suitable adhesive resinous cement such as an epoxy resin and finally the reinforced element is machine sanded. FIG. 4 illustrates a similar cylindrical tubular metallic body 17 which is extruded in a form having longitudinal wide and shallow slots 18 equally-spaced on the surface thereof. The slots 18 are inlaid with unidirectional graphite fiber strips 19 which are cemented in place along the length of the slots 18 and the reinforced tube is machine sanded to render the surface smooth and uniform to the feel.

FIG. 5 illustrates a reinforced non-tubular elongate metallic body 20 such as a conventional aluminum extrusion provided with angular projections 21 which impart strength thereto. The inner surface of each projection 21 is provided with a groove or notch 22 which is either cut into the surface after extrusion or is formed during extrusion. The notches 22 are inlaid with unidirectional graphite fiber strips 23 which are cemented in place along the length of the notches, Thereafter the strips 23 may be sanded, flush with the metal, as shown, or may extend above the surface.

If desired, conventional angular extrusions such as aluminum extrusions having angular support projections as illustrated by FIG. 5 may be reinforced by cementing enlarged unidirectional graphite fiber strips within the entire interior area of such projections to provide structural metallic bodies having exceptional strength and stiffness.

The reinforced cylindrical tubular elements of FIGS. 3 and 4 are excellent structural materials for bicycle frames, tent supports and a variety of other structural uses where lightness of weight and high strength are required. The same is true of the reinforced flat metallic element of FIG. 5 which provides increased strength for lightweight metallic extrusions conventionally used in the construction field.

While the number of reinforcements used on any metallic body will vary with the dimensions of that body, it is preferred to use at least two equally-spaced and identical reinforcements on bodies which require equal balance such as golf club shafts.

Variations and modifications may be made within the scope of the claims and portions of the improvements may be used without others.

I claim:

1. A reinforced metallic element having increased strength and stiffness comprising a thin-walled, hollow, tubular elongate metallic body having a first predetermined specific gravity and a plurality of circumferentially spaced longitudinal slots thereabout, each of said slots containing a continuous strip of unidirectional graphite fiber composition bonded therein to fill said slot and be flush with the outer surface of said metallic body, each of said strips being of a second predetermined specific gravity less than said first specific gravity of said metallic body whereby the weight of said metallic element is less than that which would result had said element been constructed solely of metal of said first predetermined specific gravity.

2. A reinforced element according to claim 1 in which said longitudinal slots extend from the outer surface of said tubular elongate metallic body inwardly into the wall thickness thereof to an extent less than the wall thickness.

3. A reinforced element according to claim 1 in which said longitudinal slots comprise inwardly-directed channels in the wall of said tubular elongate metallic body.

4. A reinforced element according to claim 1 in which said elongate metallic body comprises a lightweight metal.

5. A reinforced element according to claim 1 in which at least two of said longitudinal slots are equally-spaced on the outer surface thereof.

6. A reinforced element according to claim 1 in which said tubular elongate metallic body is tapered.

7. A reinforced element according to claim 1 in which said strips of unidirectional graphite fiber composition comprise a multiplicity of graphite fibers and a resinous binder material.

8. A reinforced element according to claim 1 comprising a tapered aluminum golf club shaft having at least two equally-spaced slots therein having said strips of graphite fiber composition bonded therein by means of a resinous adhesive.

* * * * *